United States Patent [19]

Hogan

[11] 4,211,519

[45] Jul. 8, 1980

[54] FLUID PUMP AND QUICK RELEASE MOUNTING ARRANGEMENT THEREFOR

[75] Inventor: Lawrence R. Hogan, Lake Villa, Ill.

[73] Assignee: Cole-Parmer Instrument Company, Chicago, Ill.

[21] Appl. No.: 828,482

[22] Filed: Aug. 29, 1977

[51] Int. Cl.[2] ..... F04B 43/12

[52] U.S. Cl. ..... 417/360; 417/475; 417/477

[58] Field of Search ..... 417/360, 475, 476, 477, 417/474; 418/45; 64/10

[56] References Cited

U.S. PATENT DOCUMENTS

| | | | |
|---|---|---|---|
| 2,056,936 | 10/1936 | Hayward | 417/360 |
| 2,651,264 | 8/1953 | Bruckmann | 418/45 |
| 2,880,676 | 4/1959 | Succop | 417/410 |
| 2,899,907 | 8/1959 | Becher | 417/477 |
| 3,358,609 | 12/1967 | Worth et al. | 417/477 |
| 3,507,585 | 4/1970 | Mercer | 417/475 |
| 3,841,799 | 10/1974 | Spinosa et al. | 417/477 |
| 3,927,955 | 12/1975 | Spinosa et al. | 417/477 |

FOREIGN PATENT DOCUMENTS

| | | | |
|---|---|---|---|
| 993467 | 10/1951 | France | 64/28 R |

*Primary Examiner*—Richard E. Gluck
*Attorney, Agent, or Firm*—Fitch, Even & Tabin

[57] ABSTRACT

A peristaltic pump is disclosed having two identical hingedly connected housing sections defining mating surfaces substantially coplanar with the hinge axis and the longitudinal axis of the housing to facilitate easy opening of the housing sections for loading and manipulation of a flow tube looped internally of the housing and cooperable with rotatable displacement means to effect a peristaltic pumping action on the tube. Various pump mounting arrangements are disclosed which are particularly suitable for limited access areas and which maintain the pump sections in closed positions while facilitating quick release of the pumps for servicing and the like.

18 Claims, 8 Drawing Figures

Fig. 6.
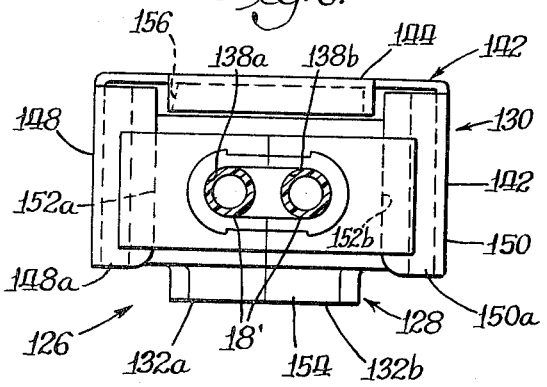
Fig. 5.
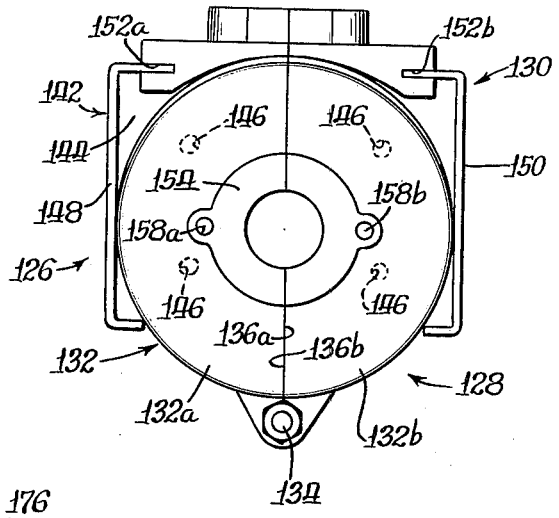
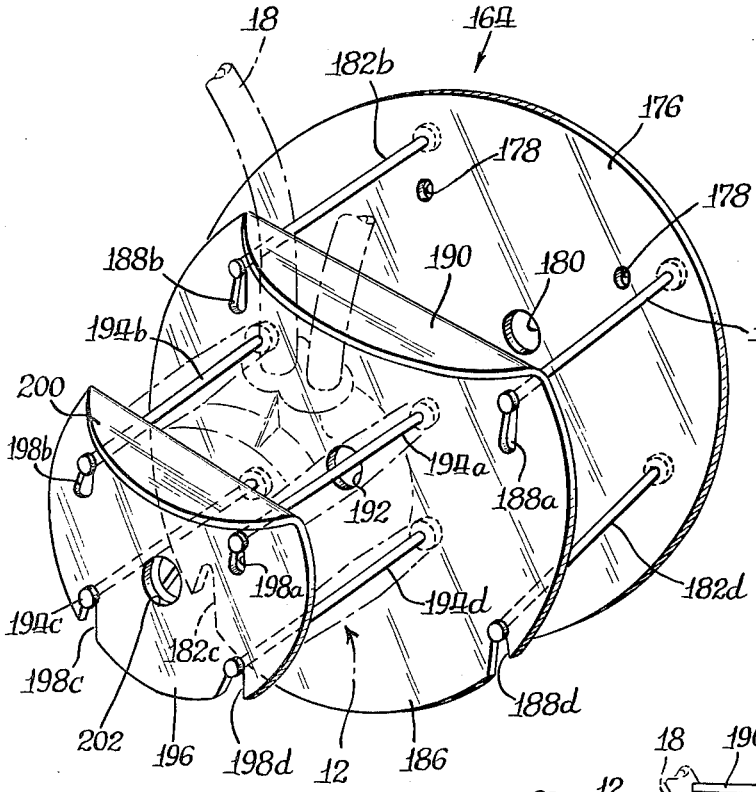
Fig. 7.
Fig. 8.
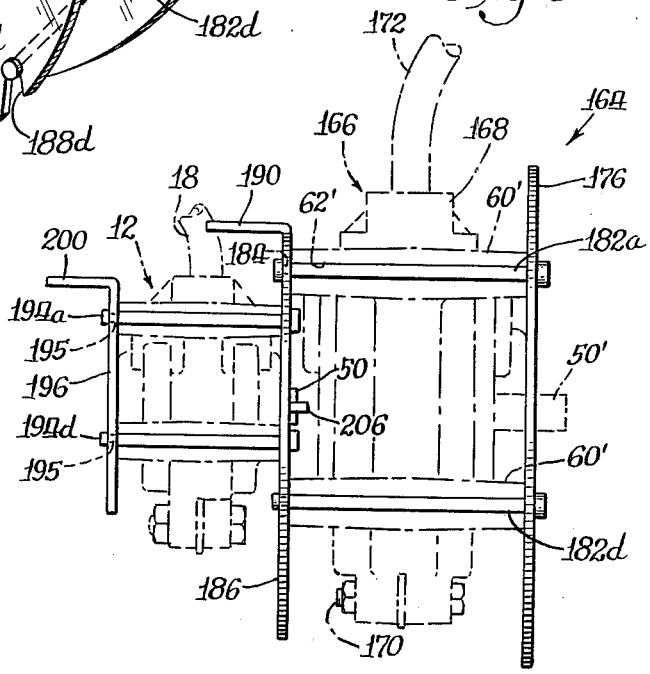

FLUID PUMP AND QUICK RELEASE MOUNTING ARRANGEMENT THEREFOR

The present invention relates generally to fluid pumps, and more particularly to a novel peristaltic pump and mounting arrangement therefor which facilitates quick release of the pump and opening of the pump housing for manipulation or replacement of the flow tube.

Fluid pumps of the peristaltic type which operate to provide a moving region or regions of compression along the length of a compressible fluid conduit or tube are generally known. Movement of the compressed region of the tubular conduit forces fluid ahead of the moving region, and the action of the tube in returning to its uncompressed condition creates a partial vacuum which effects forward flow of fluid from the region behind the compressed tube region. See, for example, U.S. Pat. No. 3,358,609, dated Dec. 19, 1967, and assigned to the assignee of the present invention.

Peristaltic pumps of the type employing compressible fluid conducting tubes on which a peristaltic action is effected by cyclically compressing the tube along a portion of its length by means of a movable element generally exhibit tube wear which requires either replacement or repositioning of the tube. Thus, the pump should be characterized by a construction which facilitates such replacement and/or manipulation of the tube without undue downtime of the pump.

It is one of the primary objects of the present invention to provide an improved peristaltic pump construction which facilitates quick and easy replacement and/or manipulation of the compressible fluid conduit or tube without the need for special tools or highly trained technicians.

Peristaltic pumps have varied uses and find particular application where it is desired to provide measured fluid flow and dispensing. For example, in contemporary fast food outlets, certain fluid-like substances, such as ketchup, mustard and other condiments, are frequently applied to food products, such as hamburgers, which are then served for consumption, often on the premises. In applying such condiments, it is economically advantageous that the condiments be drawn and dispensed from large volume supplies rather than from individual smaller packages or packets of the individual serving size. In drawing a condiment from a large volume supply, it is desirable that the quantity dispensed to each food article or product be closely controlled so as to prevent waste which, in a cumulative sense, can add appreciably to the cost of operation. Peristaltic pumps have been found particularly advantageous for this application in that they can be controlled to dispense measured amounts under rather close control and regulation.

To enhance the aesthetic appearance of a fast-food outlet wherein customers generally approach a counter contiguous to the food preparation area, it is desirable that the various hardware components be enclosed in cabinet type structures. For example, it is desirable that any pumps used to dispense condiments and the like from relatively large volume supplies be mounted within the cabinet structures even though the pumps are controlled by means externally of the cabinets. Such cabinets often are confining and offer limited access to the pumps. In the case of peristaltic type pumps which are frequently mounted directly to a drive motor, it is necessary that the pumps be readily and quickly removable from their associated drive motors so as to facilitate quick replacement and/or manipulation of the tubular conduits which convey the condiments.

Accordingly, another object of the present invention is to provide a peristaltic pump and mounting support arrangement therefor which may be located in a limited access area and which facilitate quick disconnect of the pump from the associated mounting support to replace or manipulate the fluid conduit whereafter the pump may be readily remounted in the confined operating area.

A more particular object of the present invention is to provide a peristaltic pump having a pump housing comprised of two sections hingedly connected to each other in a manner to facilitate opening of the housing sections for access to an internally supported rotary displacement mechanism and associated flexible conduit for replacement or repositioning of the conduit whereafter the housing sections are again closed to retain the displacement mechanism and conduit in operative association with each other.

A further object of the present invention is to provide a peristaltic pump and associated mounting support arrangement wherein the pump housing comprises two hinged sections and wherein the mounting support is adapted to mount the pump in quick release attachment therewith while simultaneously maintaining the two housing sections in their closed positions, the mounting arrangement facilitating quick release and remounting of the pump in a relatively confined area.

A still further object of the present invention is to provide a peristaltic pump and mounting arrangement which facilitates tandem mounting of a plurality of pumps in axial relation and also facilitates quick release of the pumps while disposed in a relatively confined area for servicing the pumps.

A feature of the present invention lies in the provision of an arrangement for mounting a peristaltic pump on a drive motor, wherein the drive motor has a quick load drive shaft assembly facilitating driving connection to the pump drive shaft without pre-orientation of the pump drive shaft during mounting of the pump on the drive motor.

Further objects and advantages of the present invention, together with the organization and manner of operation thereof, will become apparent from the following detailed description of the invention when taken in conjunction with the accompanying drawings wherein like reference numerals designate like elements throughout the several views, and wherein:

FIG. 5 is a front elevational view of a peristaltic pump and associated mounting bracket arrangement in accordance with an alternative embodiment of the present invention;

FIG. 6 is a top plan view of the pump and mounting bracket arrangement of FIG. 5;

FIG. 7 is a perspective view of a pump mounting arrangement in accordance with another embodiment of the present invention, the pump being shown in phantom; and FIG. 8 is a side elevational view of the pump mounting arrangement of FIG. 7, but showing in phantom a pair of pumps mounted in tandem.

Figure 1:
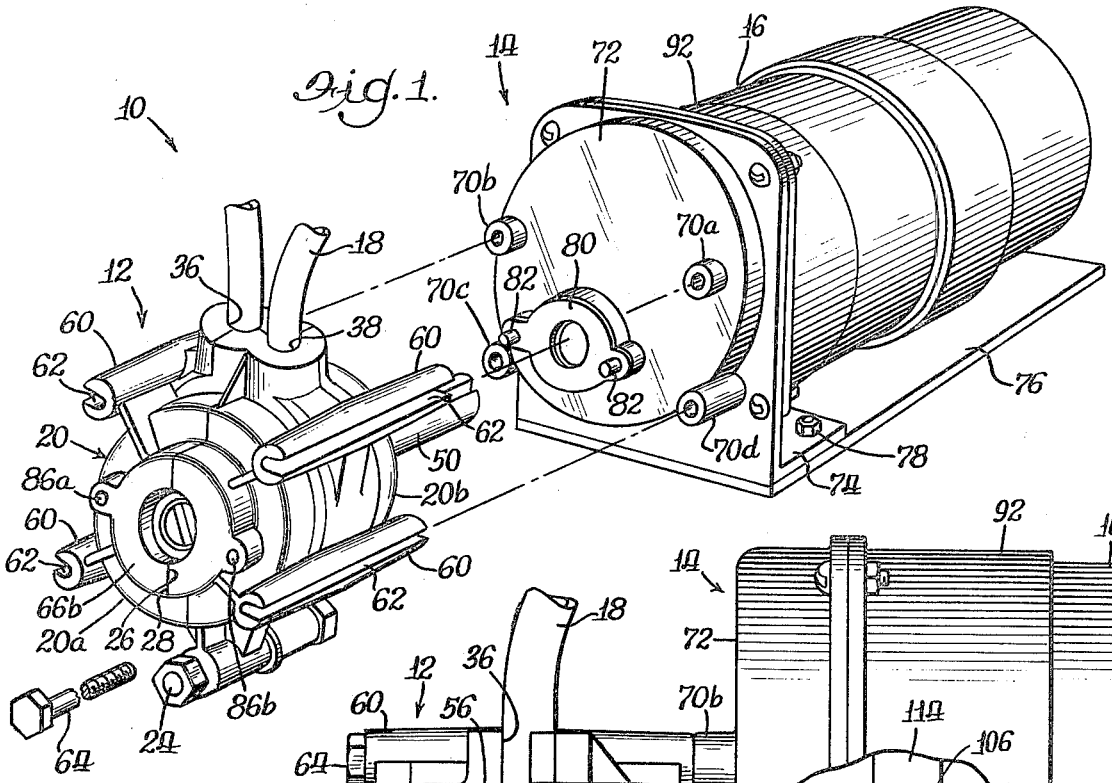
FIG. 1 is an exploded perspective view of a peristaltic pump and mounting arrangement therefor constructed in accordance with one embodiment of the present invention.

Referring now to the drawings, and in particular to FIGS. 1–4, a fluid pump and mounting arrangement therefor in accordance with one embodiment of the present invention is indicated generally at 10. The fluid pump and mounting arrangement 10 includes a fluid pump, indicated generally at 12, in the form of a peristaltic pump adapted for quick mounting on and release from mounting support means, indicated generally at 14. As used herein, the term "fluid pump" refers to a pump capable of pumping materials which can be conveyed through a tubular conduit by differential pressure operative to draw or suck the material through the conduit. Such materials may include relatively low viscosity liquids and high viscosity semi-solids.

In the illustrated embodiment, the mounting support means 14 includes an electric drive motor 16 adapted to drive the peristaltic pump 12. The peristaltic pump 12 includes a pump housing 20 which facilitates easy opening for manipulation and/or replacement of a liquid flow conduit or tube 18 when the pump is removed from the mounting support means 14. The mounting support means 14, in cooperation with the peristaltic pump 12, facilitates easy removal of the pump from the mounting support means for servicing the pump and associated tube 18, and subsequent remounting of the pump on the mounting support means.

The pump housing 20 preferably is made of a suitable transparent plastic, such as polycarbonate or an acrylic resin, and is formed in two identical halves or sections **20*a* and 20*b* hingedly connected to each other through a connecting hinge bolt 24 disposed parallel to and coplanar with the longitudinal axis of the pump housing. The housing sections 20*a* and 20*b* define mating surfaces 26 and 28, respectively, which when the housing sections are closed define a generally planar parting plane containing the longitudinal axis of the housing 20 and the hinge axis 24**.

The housing sections **20*a* and 20*b* in their closed positions define an internal pumping chamber 32 adapted to receive and support rotary displacement means, indicated generally at 34. The rotary displacement means 34 is operatively associated with the tube 18 and is adapted to create a peristaltic pumping action within the tube in a known manner. The particular details of the rotary displacement means 34 and its operative relation with the fluid conduit or tube 18** to effect a peristaltic pumping action is described in detail in the aforereferenced U.S. Pat. No. 3,358,609.

Briefly, the tube 18 is deformable and has a memory so that the tube will return to its original shape after being deformed by a moving force applied to compress the tube wall. As is well known in the operation of peristaltic pumps, moving regions of compression are intermittently created along the length of the tube 18 disposed within the pump body 20 to push fluid within the tube forwardly from the compressed region whereafter return of the tube wall to its uncompressed condition effects a partial vacuum which sucks fluid forwardly from the region of the tube rearwardly of the previously compressed region.

In the illustrated embodiment, the tube 18 extends through an opening in the housing 20 defined by a first opening 36 in the housing section **20*a* and a second opening 38 in the housing section 20*b*. The tube 18 forms an internal loop within the pumping chamber 32 wherein the tube is received within a recess 42 circumferentially of the chamber 32. The axes of the openings 36 and 38 are generally radial to the curvature of the recess 42 so that the tube is forced to deviate from its loop curvature as it enters and leaves the housing 20. During pumping, a slight bulge is created in the tube 18 at the inner edge of one of the openings 36 or 38 serving as the exit opening for the tube. Such bulge and the angular deviation of the tube 18 at the openings 36, 38 inhibits the tube from annular movement through the housing 20** as it is subjected to radially resultant forces caused by moving regions of compression along its looped portion.

Figure 3:
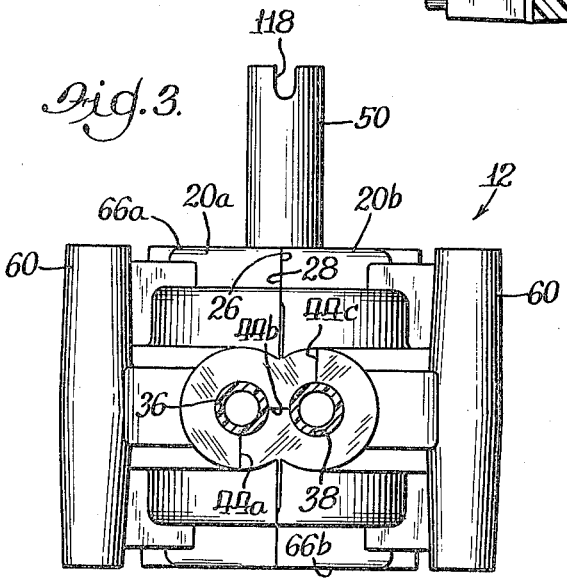
FIG. 3 is a plan view of the peristaltic pump of FIG. 2 removed from the drive motor.
Figure 4:
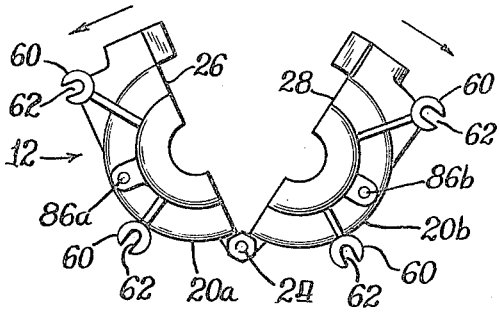
FIG. 4 is a front elevational view, reduced in scale, of the pump of FIG. 1 but showing the housing sections in open positions.

It is seen from FIG. 3 that the mating surfaces 26 and 28 deviate from their otherwise planar mutual parting plane at the upper region of the housing 20 adjacent the openings 36 and 38, the mating surfaces at the upper region being designated by parting plane lines **44*a*, 44*b* and 44*c*. With this construction, the tube 18 may be inserted laterally into the openings 36 and 38** with the housing sections open, the tube being retained within each opening by engagement about approximately 270° of its peripheral surface.

The rotary displacement means 34 includes a pair of axially spaced annular discs 46 and 48 mounted in parallel relation on a cylindrical drive shaft 50 rotatably supported through bearings 52 and 54 within the housing 20 coaxial with the longitudinal axis of the housing. With the housing sections **20*a*, *b* open, the rotary displacement means 34 can be readily removed. The discs 46 and 48 rotatably support three cylindrical rollers 56 in parallel, equidistantly circumferentially spaced relation about the drive shaft 50. The rollers 56 are adapted to successively engage the internal looped portion of tube 18 in response to rotation of the drive shaft 50 so as to compress the tube within the recess 42 and form moving regions of compression which force the fluid within the tube forwardly of the moving compressed regions. The portion of the recess or groove 42 opposite the openings 36 and 38 is shallower than the remaining portion of the recess so as to cause the tube to be fully compressed by successive rollers 56 as they traverse the shallow portion of the recess, whereby to effect momentary multiple occlusion during rotation of the drive shaft 50. As the tube 18 returns to its uncompressed condition after compression by each roller 56, a partial vacuum is created in the tube tending to draw or suck the fluid rearwardly of the previously compressed region through the tube in the direction of movement of the rollers 56. This action is continued until the desired quantity of fluid has been passed through the tube 18**.

With the liquid pump 12 thus far described, it is seen that the housing sections **20*a*, *b* can be readily opened in lateral directions to provide access to the internal rotary displacement means 34 and associated tube 18 for servicing and/or replacement of the tube 18. The tube receiving recess or groove 42 is made symmetrical about the mating surfaces 26 and 28 to facilitate rotation of the rotary displacement means 34** in either rotational direction for effecting a peristaltic pumping action. This feature permits the rotational direction of the drive shaft 50 to be temporarily reversed after ceasing flow in a predetermined direction so that wasteful discharge or dripping is virtually eliminated. The reversible pumping feature enables a single pump to be utilized to both fill and empty a reservoir of flowable fluid. It is also seen that by providing two pump housing sections hingedly connected about a hinge axis coplanar with and spaced from the longitudinal axis of the pump, a mechanical advantage is obtained in closing the housing sections about the tube 18 and rollers 56.

Figure 2:
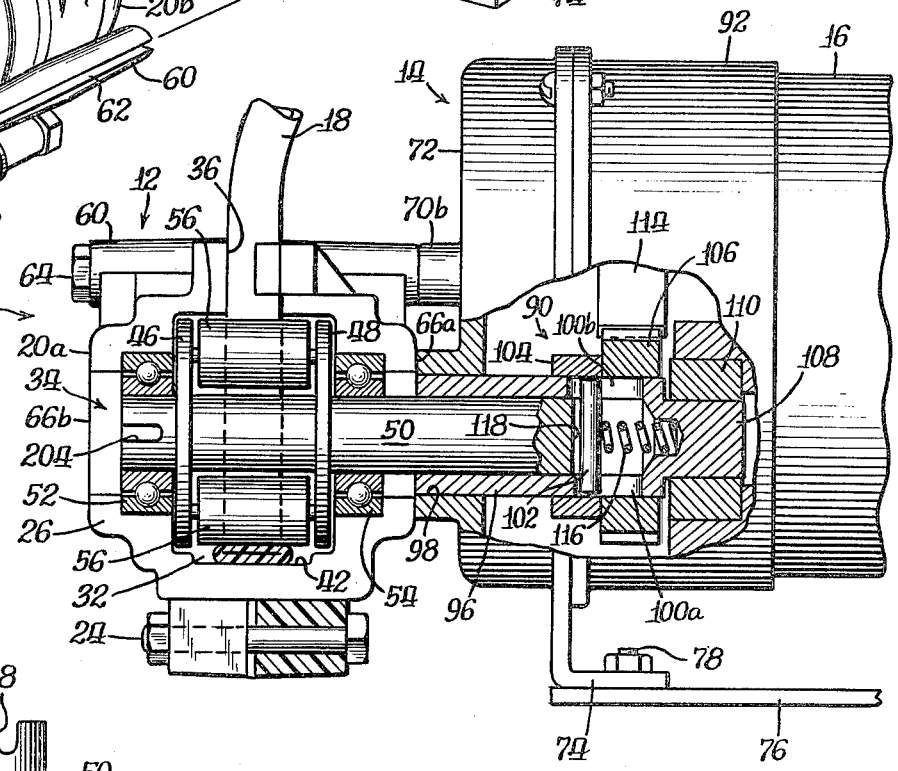
FIG. 2 is a fragmentary longitudinal sectional view of the peristaltic pump of FIG. 1 mounted on the drive motor.

An important feature of the liquid pump and mounting arrangement 10 in accordance with the present invention is that it facilitates quick and easy mounting of the pump 12 to the mounting support means 14. This feature is particularly desirable when the mounting support means is located in a relatively confined or remote area where access to the pump is somewhat restricted. To facilitate ease of mounting, the pump 12 includes a plurality of mounting sleeves 60 preferably formed integral with the housing 20. In the illustrated embodiment, the peristaltic pump 12 has two mounting sleeves 60 formed on each pump section 20*a, b,* each mounting sleeve having a longitudinally extending bore or opening 62 therethrough adapted to receive an elongate mounting screw 64. The bores 62 open laterally outwardly from the peripheral surfaces of the respective mounting sleeves so that the screws 64 may be inserted either laterally or axially into the mounting bores. The axes of the mounting bores 62 are parallel to the hinge axis 24 and are equidistantly circumferentially spaced about the longitudinal axis of the housing 20. As seen in FIGS. 2 and 3, the longitudinal lengths of the mounting sleeves 60 are substantially equal to the longitudinal length of the pump housing 20 as established by the outer end surfaces 66*a* and 66*b* on the housing.

The ends of the mounting sleeves 60 are adapted to engage internally threaded mounting bosses 70*a–d* formed on a mounting bracket 72 having a support leg 74 for securing the mounting bracket in upstanding relation on a base plate 76, as through bolts 78. The mounting bracket 72 has an outwardly extending boss 80 to which is symmetrically affixed a pair of locating and retaining pins 82 adapted to be received within correspondingly located bores 86*a* and 86*b* formed in both end surfaces 66*a* and 66*b* of the pump housing 20, as seen for end surface 66*b* in FIG. 1. In mounting the pump 12 on the mounting bracket 72, the mounting sleeves 60 of housing 20 are aligned with the mounting bosses 70*a–d* on the support bracket 72 and the screws 64 are inserted into the bores 62 and threaded into the bosses 70*a–d.* Simultaneously with positioning the sleeves 60 against the mounting bosses 70*a–d,* the locating and retaining pins 82 are received within the opposed mounting bores 86*a, b* in the housing 20 so as to define cooperating detent means adapted to maintain the housing sections in closed relation. It can be seen that very little room is needed in which to mount the pump on the mounting bracket 72, it being only necessary that there be sufficient room to axially align the pump 12 with the mounting boss 80 and threadedly attach the screws 64.

As the pump 12 is mounted on the mounting bracket 72, the drive shaft 50, which extends axially outwardly from the end of the housing 20 intended to face the mounting bracket, is inserted within a drive shaft assembly, indicated generally at 90 in FIG. 2, supported by the support bracket 72 and a mating rearward housing 92 to which is secured the electric motor 16. The drive shaft assembly 90 facilitates quick attachment with the drive shaft 50 and includes a guide sleeve 96 rotatably supported within a cylindrical bore 98 in the support bracket 72. The sleeve 96 has an internal bore of sufficient size to receive the drive shaft 50 therein, and has a pair of diametrically opposed longitudinal slots 100*a* and 100*b* which receive the opposite ends of a transverse drive key 102. The drive key 102 is retained within the slots 100*a* and 100*b* by a retainer sleeve 104 and an annular drive gear 106 secured on the peripheral surface of the sleeve 96 to overlie the slots 100*a, b.* The guide sleeve 96 has a reduced diameter rearward end 108 supported within an annular bushing 110 mounted within the housing 92. The annular gear 106 is fixed on the sleeve 96 and is matingly cooperable with a drive gear 114 rotatably driven by the electric motor 16 so as to effect rotation of the sleeve 96 and associated drive key 102. A coil compression spring 116 acts against the drive key 102 to urge it toward the forward ends of the slots 100*a, b.*

As best seen in FIG. 3, the outer end of the drive shaft 50 has a transverse drive slot 118 adapted to receive the drive key 102 therein when the pump 12 is mounted on the support bracket 72 with the drive shaft inserted into the sleeve 96. If the drive slot 118 is not properly aligned with the drive key 102 when the shaft 50 is inserted into the sleeve 96, the drive key will move rearwardly against the action of the spring 116 to facilitate mounting of the pump 12 on the support bracket 72. When the drive motor 16 is energized, initial rotation of the drive key 102 will align it with the drive slot 118 whereupon the spring 116 will urge the drive key into the drive slot to effect driving rotation of the pump shaft 50.

FIGS. 5 and 6 illustrate another embodiment of a fluid pump and mounting arrangement, indicated generally at 126, in accordance with the present invention which facilitates quick and easy mounting and release of a peristaltic pump, indicated generally at 128, relative to mounting support means, indicated generally at 130. The peristaltic pump 128 includes a housing 132 having two identically shaped housing sections 132*a* and 132*b* hingedly connected to each other by a hinge bolt 134. The housing sections 132*a* and 132*b* define planar mating surfaces 136*a* and 136*b* which lie in a plane containing the longitudinal axis of the housing 132 and the hinge axis 134. The housing 132 has an internal pump chamber similar to the aforedescribed pump chamber 32 and releasably mounts rotary displacement means (not shown) therein for effecting a peristaltic pumping action within a looped tube 18′ in substantially identical fashion as described above in respect to the peristaltic pump 12. As best seen in FIG. 6, the looped tube 18′ enters and exits an opening in the housing 132 defined by complementary openings 138*a* and 138*b* formed in the housing sections 132*a* and 132*b,* respectively.

The mounting support means 130 is adapted to support the peristaltic pump 126 while simultaneously maintaining the housing sections in their closed positions. To this end, the mounting support means 130 includes a support bracket 142 having a planar rear wall 144 adapted to be secured to the mounting bosses 70*a–d* on the above-described mounting bracket 72 through support screws (not shown) received through suitably positioned openings 146 (FIG. 5) in the rear wall 144.

The support bracket 142 includes a pair of forwardly extending generally C-shaped arms 148 and 150 substantially normal to the plane of the rear wall 144. The arms 148 and 150 include upper flange portions 148*a* and 150*a*, respectively, which are received within longitudinally extending groove or slots 152*a* and 152*b* in the housing sections 132*a, b* when the housing sections are in their closed positions, whereby to support the pump 128 and maintain the housing sections in their closed positions. The mounting flanges 148*a*, 150*a* and the associated pump housing slots 152*a*, 152*b* are further positioned so that when the housing 132 is mounted on the mounting bracket 142, the drive shaft of the rotary displacement means within the housing 132 is received within the boss 80 on the mounting bracket 72 in driving relation with the quick load drive shaft assembly 90 described in respect to FIG. 2.

The pump housing 132 has axially outwardly extending bosses 154 and 156 at its opposite ends defining pairs of symmetrical mounting bores 158*a, b* which are similar to the aforedescribed mounting bores 86*a, b* and serve to receive the mounting pins 82 on the mounting boss 80 when the housing 132 is mounted within the support bracket 142 on the mounting bracket 72. It will be understood that the rear wall 144 of support bracket 142 has suitable openings therethrough to receive the mounting pin 82 and facilitate entry of the pump drive shaft 50 into the mounting boss 80 on the mounting bracket 72.

It can be seen that the peristaltic pump 128 may be readily removed from the mounting bracket 142 by a mere forward movement of the housing so as to release the support flanges 148*a* and 150*a* from the housing slots 152*a, b* whereafter the pump housing sections may be opened and the tube 18' replaced or otherwise manipulated. Thereafter, he housing sections are again closed and the housing mounted on the support bracket 152 with the slots 152*a, b* receiving the mounting flanges 148*a* and 150*a* therein in supporting relation.

FIGS. 7 and 8 illustrate another embodiment of a peristaltic pump and mounting arrangement therefor, indicated generally at 164, in accordance with the present invention which facilitates relatively quick and simple mounting of one or more peristaltic pumps onto and disassembly from a pump support arrangement located in a relatively inaccessible or remote area. The fluid pump and mounting arrangement 164 is illustrated in conjunction with the releasable mounting of a first peristaltic pump 12 as aforedescribed and a second peristaltic pump, indicated generaly at 166, similar to but larger in size than the pump 12. The pump mounting arrangement 164 is particularly suited for axial tandem mounting of two or more pumps.

Because the peristaltic pump 166 is similar to the peristaltic pump 12 described hereinabove in respect to FIGS. 1–4, it will not be described in detail herein. Briefly, the peristaltic pump 166 includes a pump housing 168 comprised of two housing sections hingedly connected about a hinge aixs 170, each housing section having two longitudinal mounting sleeves 60' thereon which facilitate support of the pump 166 by means of support rods to be described. The pump housing 168 releasably supports a peristaltic pump assembly therein operative to effect a peristaltic pumping action on a tube 172 looped circumferentially about the internal pump assembly.

The pump mounting arrangement 164 includes a rear support plate 176 having four mounting holes 178 therein positioned to adapt the plate for mounting on the mounting bosses 70*a–d* on the support bracket 72, or on a similar but larger size mounting bracket. The support plate 176 has a circular opening 180 centrally of the holes 178 for receiving the drive shaft 50' of the pump 166 therethrough for coupling the shaft 50' to a drive motor (not shown) in similar fashion to connection of the drive shaft 50 of FIG. 2 to the electric motor 16.

The support plate 176 has four support rods 182*a–d* secured thereto in normal relation and adapted to be received through axial bores 62' in the mounting sleeves 60' of pump 166. Each of the support rods 182*a–d* has an annular groove 184 adjacent its outer end to receive a second mounting plate 186 in supporting relation thereon. As best seen in FIG. 7, the support plate 186 has four elongated slots 188*a–d* therethrough which are positioned to receive the support rods 182*a–d*, respectively. The slots 188*a–d* are generally tear-drop shaped, the lower slots 188*c, d* opening outwardly of the peripheral edge of the support plate 186. The support plate 186 has a forwardly turned lifting flange 190 formed thereon which facilitates grasping of a support plate 186 during mounting on or release from the support rods 182*a–d*.

In mounting the peristaltic pump 166 on the support plate 176, the mounting sleeves 60' receive the support rods 182*a–d* therethrough and the mounting plate 186 is positioned to receive the support rods through the openings 188*a–d*, whereafter plate 186 is moved to snugly seat within the annular grooves 184 in the support rods 182*a–d*. The support plate 186 has an opening 192 therethrough which axially aligns with the opening 180 when the plate 186 is mounted on the rear plate 176.

The support plate 186 has four forwardly extending support rods 194*a–d* secured thereto in normal relation, the support rods 194*a–d* being positioned to be received within the mounting sleeves 60 on the peristaltic pump 12. The peristaltic pump 12 is retained on the support rods 194*a–d* against the support plate 186 by a forward retainer plate 196 having suitably positioned tear-shaped slots 198*a–d* positioned to receive the support rods 194*a–d* and seat within annular grooves 195 in the support rods. The retainer plate 196 has a flange 200 facilitating grasping of the retainer plate for mounting onto and removing from the support rods 194*a–d*. The retainer plate 196 also has a circular opening 202 therethrough to provide access to the forward end of the rotary shaft 50 in the peristaltic pump 12 when assembled between the plates 186 and 196.

It is seen from FIG. 2 that the peristaltic pump housing 20 is open on both axial ends thereof so that the drive shaft 50 may extend outwardly from either end. The end of the rotary drive shaft 50 opposite the outer extension thereof shown coupled to the electric drive motor 16 through the drive sleeve 96 may have a suitable transverse drive slot 204 therein similar to the transverse slot 118 shown receiving the drive key 102. The transverse slot 204 is adapted to receive a drive key, indicated at 206 in FIG. 8, cooperative with the drive shaft 50 in the peristaltic pump 12 and the associated end of the drive shaft 50' in the peristaltic pump 166 whereby to facilitate operation of the pump 12 from the drive shaft 50' of the peristaltic pump 66.

It is thus seen that the mounting arrangement 164 of FIGS. 7 and 8 facilitates mounting of two or more peristaltic pumps in tandem relation with their drive shafts axially aligned and interconnected such that driving rotation of the rearwardly mounted pump is operative to drive the forwardly mounted pumps. Disassembly of the forward peristaltic pump 12 from its associated support plate 186 is facilitated by merely grasping the flange 200 and lifting the retainer plate 196 from the support rods 194*a–d* whereafter the peristaltic pump 12 may be removed from the support rods 194*a–d*. Similarly, lifting the flange 190 on the support plate 186 facilitates removal of the support plate 186 from the support rods 182*a–d* allowing removal of the peristaltic pump 166. Remounting of the pumps 12 and 166 is effected by merely reversing this procedure.

Thus, in accordance with the present invention, various embodiments of peristaltic pumps have been disclosed which employ pump housing sections facilitating relative opening and closing of the pump sections to provide access to and servicing of an internal pump assembly and associated tube upon which a peristaltic pumping action is effected. By hinging the pump housing sections about hinge axes coplanar with and spaced from the longitudinal axes of the pump housings, mechanical advantages are provided which reduce the manual forces required to close the pump sections onto the internal peristaltic pump assembly and associated looped tube.

Additionally, various embodiments of the pump mounting arrangement have been disclosed which facilitate relatively simple and quick mounting of the various peristaltic pumps onto drive motors, the mounting arrangements facilitating mounting and removal in relatively inaccessible or remote pump operating positions.

While preferred embodiments of the present invention have been illustrated and described, it will be understood to those skilled in the art that changes and modifications may be made therein without departing from the invention in its broader aspects. Various features of the invention are called for in the following claims.

What is claimed is:

1. In a peristaltic pump which includes a housing defining a longtiudinal axis, said housing having an internal chamber and an opening communicating with said chamber, a length of tube extending through said opening and having a portion looped internally of said chamber so as to form a cntinuous flow passage through said tube, and displacement means supported within said chamber and operatively associated with said tube to facilitate a peristaltic pumping action within said tube; the improvement wherein said housing comprises two housing sections hingedly connected to each other for relative movement between open and closed positions about a hinge axis substantially coplanar with and spaced from said longitudinal axis in substantially parallel relation therewith, said two housing sections defining a parting plane therebetween substantially coplanar with said longitudinal and hinge axes when said housing sections are in relatively closed positions wherein said housing sections define said internal chamber and enclose and support said displacement means, said housing sections in their said open positions facilitating removal of said displacement means and manipulation and replacement of said tube, each of said housing sections defining a tube receiving opening communicating with said chamber and opening externally of said housing, said parting plane passing through said openings in the longitudinal direction thereof such that when said housing sections are in their said open positions, said tube may be inserted within each of said openings by movement of said tube in a direction substantially transverse to its longitudinal axis, said housing sections being adapted to retain said tube in assembled relation therewith when said housing sections are moved between their said open and closed positions.

2. The improvement as defined in claim 1 wherein said housing sections include means facilitating retention of said housing sections in their said closed positions.

3. The improvement as defined in claim 1 wherein said housing sections are identical in configuration.

4. The improvement as defined in claim 1 wherein said displacement means is rotatably supported within said chamber, said displacement means including an operating shaft extending externally of said housing and facilitating rotation of said displacement means.

5. The improvement as defined in claim 1 wherein said parting plane passes through said openings so that said housing peripherally of said openings establishes approximately 270° contact with said tube when inserted within said openings with said housing sections in their said open positions.

6. The improvement as defined in claim 1 wherein one of said tube receiving openings is provided in each of said housing sections, the axes of said tube receiving openings being such that the portions of said tube extending through said openings have substantially different curvature than said loop portion of said tube when said housing sections are in their said closed positions.

7. A peristaltic pump and mounting arrangement comprising, in combination, a peristaltic pump having a housing defining a longitudinal axis and an internal chamber, rotary displacement means supported by said housing within said chamber, said housing comprising at least two housing sections hingedly connected to each other for relative movement about a hinge axis between closed positions supporting and enclosing said displacement means and open positions providing access to said displacement means, said hinge axis being disposed substantially coplanar with and parallel to said longitudinal axis, said two housing sections defining a parting plane therebetween substantially coplanar with said longitudinal and hinge axes when said housing sections are in relatively closed positions, each of said housing sections defining a conduit receiving opening communicating with said chamber and opening externally of said housing, said conduit receiving openings being adapted to receive a tubular conduit therethrough with a portion of the conduit disposed within said chamber so as to form a continuous flow passage through said conduit, said conduit being cooperable with said displacement means within said chamber to facilitate a peristaltic pumping action within said conduit upon rotation of said displacement means, said parting plane passing through said openings in the longitudinal direction thereof such that when said housing sections are in their said open positions, said conduit may be inserted within each of said openings by movement of said conduit in a direction substantially transverse to its longitudinal axis, said housing sections being adapted to retain said conduit in assembled relation within said openings when said housing sections are moved between their said open and closed positions, and mounting support means having means cooperative with said housing sections to support said housing sections in predetermined closed positions relative to said mounting support means, said mounting support means facilitating release of said housing from said mounting support means, opening of said housing section relative to each other for access to said displacement means and said conduit, and reclosing and remounting of said housing sections on said mounting support means.

8. The combination as defined in claim 7 wherein said housing sections and said mounting support means define cooperating detent means adapted to retain said housing sections in their said closed positions when said housing means is supported by said mounting support means in said predetermined position.

9. The combination as defined in claim 8 wherein said cooperating detent means includes at least two fixed locating pins mounted on said mounting support means, said housing sections each having a recess detent therein adapted to receive one of said locating pins therein when said housing sections are mounted on said mounting support means in their said closed positions.

10. The combination as defined in claim 7 wherein said mounting and support means includes rotary drive means, said displacement means being rotatable within said chamber and having a drive shaft extending externally of said housing, said mounting support means being adapted to support said housing with said drive shaft in axial alignment with said rotary drive means.

11. The combination as defined in claim 10 including drive key means cooperative with said rotary drive means and said drive shaft when said housing is mounted on said mounting support means so as to effect rotation of said displacement means upon energizing said rotary drive means.

12. The combination as defined in claim 11 wherein said drive shaft has a transverse slot in its outer end registrable with said drive key means to couple said drive shaft to said rotary drive means, and including resilient means operatively associated with said drive key means and adapted to facilitate mounting of said housing on said support means when said drive key means is not in registry with said transverse slot, said resilient means urging said drive key means into said transverse slot upon initial actuation of said rotary drive means.

13. The combination as defined in claim 7 wherein said housing includes at least two longitudinally extending grooves therein, said mounting support means including at least two support flanges adapted to be received within said longitudinal grooves when said housing is mounted on said mounting support means with said housing sections in their said closed positions.

14. A peristaltic pump and mounting arrangement comprising, in combination, a peristaltic pump having a housing defining a longitudinal axis and an internal chamber and having at least one opening communicating with said chamber and opening externally of said housing, a tubular conduit extending through said opening and having a portion disposed within said chamber so as to form a continuous flow passage through said conduit, displacement means mounted within said chamber and cooperable with said conduit to facilitate a peristaltic pumping action within said conduit, said housing comprising at least two housing sections hingedly connected to each other for relative movement about a hinge axis between closed positions supporting and enclosing said displacement means and open positions providing access to said displacement means and said conduit, said hinge axis being disposed substantially coplanar with and parallel to said longitudinal axis, each of said housing sections having at least one mounting sleeve thereon in parallel relation to and spaced from the longitudinal axis of said housing, each of said mounting sleeves having an opening extending longitudinally therethrough and opening laterally outwardly along the full length of the corresponding mounting sleeve, and mounting support means including releasable mounting screws adapted to be inserted within said mounting sleeves so as to releasably retain said housing means on said mounting support means with said housing sections in their said closed positions, said mounting support means facilitating release of said mounting screws so as to enable removal of said housing from said mounting support means and opening of said housing sections for access to said displacement means and said conduit, and reclosing and remounting of said housing sections on said mounting support means.

15. The combination as defined in claim 14 wherein said mounting support means further includes a plurality of locating pins thereon the axes of which are parallel to the axes of said mounting screws when secured to said mounting support means, said housing having recess detents therein cooperable with said locating pins to receive said locating pins when said housing is mounted on said mounting support means with said housing sections in their said closed positions.

16. A peristaltic pump and mounting arrangement comprising, in combination, peristaltic pump having a housing defining a longitudinal axis and an internal chamber and having at least one opening communicating with said chamber and opening externally of said housing, a tubular conduit extending through said opening and having a portion disposed within said chamber so as to form a continuous flow passage through said conduit, displacement means mounted within said chamber and cooperable with said conduit to facilitate a peristaltic pumping action with said conduit, said housing comprising at least two housing sections hingedly connected to each other for relative movement about a hinge axis between closed positions supporting and enclosing said displacement means and open positions providing access to said displacement means and said conduit, said hinge axis being disposed substantially coplanar with and parallel to said longitudinal axis, each of said housing sections having at least one mounting sleeve thereon in substantially parallel relation to and spaced from the longitudinal axis of said housing, each of said mounting sleeves having an opening extending longitudinally therethrough, and mounting support means including a mounting plate having a plurality of generally parallel support rods secured thereon and spaced laterally apart a distance sufficient to be received through said mounting sleeves so as to releasably retain said housing on said mounting plate when said housing sections are in their said closed positions, said support rods being of sufficient length to extend fully through said mounting sleeves so as to extend outwardly therefrom, said support rods each having an annular retainer groove formed adjacent its outer end, and including a retainer plate separable from said housing and having a plurality of openings formed therethrough each of which is positioned and shaped to receive the outer end of a corresponding one of said support rods therethrough with said retainer plate in a first orientation relative to said support rods; said retainer plate being thereafter moveable, to affect cooperation of said retainer plate with said retainer grooves in the corresponding outer ends of said support rods so as to releasably retain said retainer plate on said support rods whereby to retain said housing on said mounting support means.

17. The combination as defined in claim 16 wherein said mounting plate comprises a first mounting plate, and including a second mounting plate having a plurality of second support rods secured thereto, said second support rods being adapted to support a similar pump housing thereon, and said second mounting plate being adapted for releasable mounting on said first support rods so as to axially align the associated pump housings in tandem relation.

18. The combination of claim 17 wherein said second mounting plate and said retainer plate have lifting flanges thereon facilitating grasping and manipulation thereof.

* * * * *

UNITED STATES PATENT AND TRADEMARK OFFICE

CERTIFICATE OF CORRECTION

PATENT NO. : 4,211,519

DATED : July 8, 1980

INVENTOR(S) : Lawrence R. Hogan

It is certified that error appears in the above-identified patent and that said Letters Patent are hereby corrected as shown below:

Column 7, line 3, "groove" should be --grooves--.

Column 7, line 33, "he" should be --the--.

Column 9, line 42, "cntinuous" should be --continuous--.

Column 12, line 34, "with" should be --within--.

Signed and Sealed this

*Sixteenth* Day of *December 1980*

[SEAL]

*Attest:*

SIDNEY A. DIAMOND

*Attesting Officer*

*Commissioner of Patents and Trademarks*